US005215237A

United States Patent [19]

Wu

[11] Patent Number: 5,215,237

[45] Date of Patent: Jun. 1, 1993

[54] MULTI-FUNCTION WALLET

[76] Inventor: Shih-fu Wu, 2Fl, 108, Kweilin Rd, Taipei, Taiwan

[21] Appl. No.: 721,387

[22] Filed: Jun. 26, 1991

[51] Int. Cl.[5] ..... A45F 5/00

[52] U.S. Cl. ..... 224/230; 224/252; 150/132; 402/12

[58] Field of Search ..... 224/252, 229, 230, 236, 224/247, 248, 250, 254; 150/132, 133, 143, 149, 135, 136; 281/45, 46, 47, 48; 402/8, 9, 12, 60, 68, 80 R

[56] References Cited

U.S. PATENT DOCUMENTS

| | | | |
|---|---|---|---|
| 664,544 | 12/1900 | Gilson | 402/12 |
| 826,460 | 7/1906 | Wirt | 402/68 |
| 884,134 | 4/1908 | De Graw | 402/12 |
| 912,112 | 2/1909 | Goodyear | 402/12 |
| 1,679,606 | 8/1928 | Graves | 224/252 |
| 1,792,862 | 2/1931 | Oyler | 224/252 |
| 2,421,487 | 6/1947 | Dyck | 402/68 |
| 2,788,040 | 4/1957 | Hullweck | 224/229 |
| 2,882,575 | 4/1959 | Meyer | 281/46 |
| 3,116,738 | 1/1964 | Wentges | 281/45 |
| 4,913,327 | 4/1990 | Wu | 281/250 |

FOREIGN PATENT DOCUMENTS

| | | | |
|---|---|---|---|
| 804681 | 10/1936 | France | 402/12 |
| 164560 | 12/1933 | Switzerland | 281/47 |

*Primary Examiner*—Henry J. Recla
*Assistant Examiner*—Glenn T. Barrett
*Attorney, Agent, or Firm*—Yuso International Patent and Trademark Office

[57] ABSTRACT

A multi-function wallet comprising a leather cover, at least two strips, a sub-wallet, a plurality of notebook papers, a string, a bead chain, a hook and a fastening hook; the string is to pass through holes on the leather cover, the strips, and the sub-wallet so as to fasten all the aforesaid part into one piece; both ends of the string are fastened the hook and the bead chain together. The fastening hooks are fixedly connected with the bead chain. The strips mounted on the leather cover and the sub-wallet are used for clamping banknotes and notebook papers respectively. The inner side of the leather cover has a large bag for storing ID card or the like; the inner side of the inner leather sheet of the sub-wallet has a partition flap and a lid flap; the partition flap can be opened partially, and used for storing ID card or the like. The inner side of another inner leather sheet has several coin bags for storing different coins. The fastening hook is used to attach the wallet on user's waist belt; the hook is to be hooked on waist belt for showing the bead chain as a decorative article.

4 Claims, 5 Drawing Sheets

MULTI-FUNCTION WALLET

BACKGROUND OF THE INVENTION

Most conventional wallets are not suitable for storing coins, and have no notebook function; they can only carry a limited number of banknotes; further, it is difficult to count the banknotes in such wallets. Such a wallet can only be carried by inserting it in a pocket, or a handbag, or by hand. To carry a wallet in a person's hand would cause one's hand to feel uncomfortable or painful. Another type of wallet as shown in U.S. Pat. No. 4913326 has a strip plate and a string for holding banknotes; it can carry a plurality of banknotes without being discovered by other persons; however, the banknotes therein are susceptible to being viewed by other persons upon the wallet being pulling out of a pocket or a garment; moreover, such a wallet is not suitable for carrying coins, ID cards or the like.

SUMMARY OF THE INVENTION

This invention relates to a multi-function wallet, comprising a leather cover, a plurality of strips, a sub-wallet, a plurality of notebook papers, a string, a bead chain, a hook and a fastening hook. The prime feature of the wallet is that it can, in addition to the functions of a normal wallet, carry different coins in a sub-wallet therein to avoid the drawback of a conventional wallet, in which the coins are often irregularly crowded.

Another feature of the present invention is that it has a notebook part and a banknote carrying part; the notebook part can deceive a pickpocket into thinking that there are no banknotes in the wallet; it is easy and convenient to a user to insert in and pull out banknotes, and to count the banknotes without pulling them out.

Still another feature of the present invention is that the wallet has a string, whereby the wallet has a loop to be carried like a handbag to be hung around the arm instead of holding in the person's hand. The string is further connected with a bead chain and a fastening hook to be attached to a user's waist belt for decoration function; the wallet may also be hung inside a user's pants for concealment and safety purposes upon the user walking in a crowded public place.

A further feature of the present invention is that the wallet has a sub-wallet for carrying additional articles.

DETAILED DESCRIPTION

Figure 1:
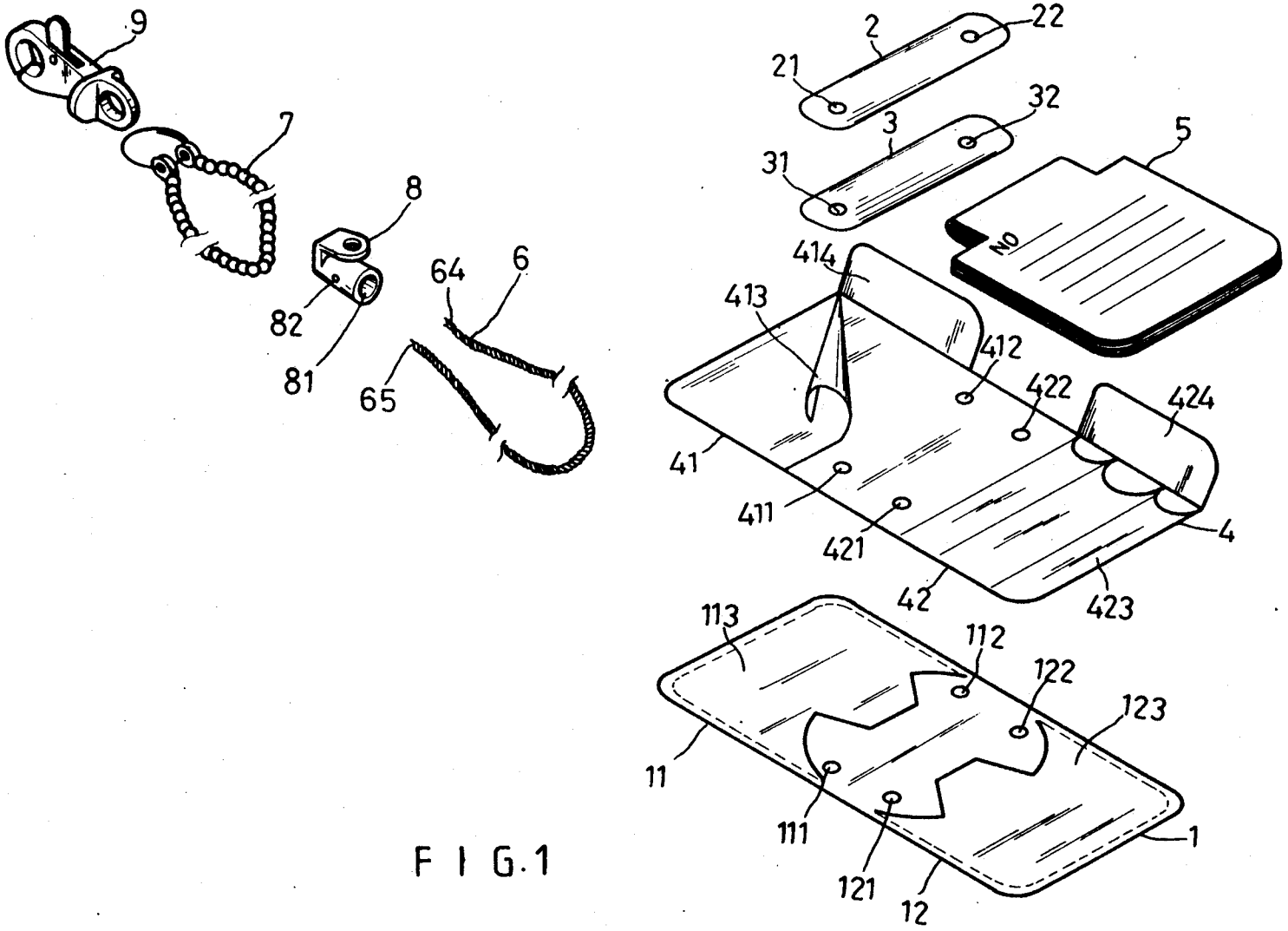
FIG. 1 is a disassembled view of an embodiment according to the present invention.

Referring to FIG. 1, the embodiment according to the present invention comprises a leather cover 1, two strips 2 and 3, a sub-wallet 4, a notebook 5, a string 6, a bead chain 7, a hook 8, and a fastening hook 9. The leather cover 1 is substantially a rectangular sheet of leather to be divided into an upper leather part 11 and a lower leather part 12; the center connecting part of the upper and lower leather parts 11 and 12 has two pairs of oblong holes 111, 112, 121 and 122. The distance between the oblong holes 111 and 112 is such that it can be slightly wider than a short side of a banknote, and the same is true of the distance between holes 121 and 122. Both the upper and lower leather parts 11 and 12 have two large pockets 113 and 123 with opposite openings respectively for storing ID cards, credit cards, and other identification papers. The two strips 2 and 3 are substantially two flexible and rectangular pieces, of which each has two round holes 21, 22, (or 31 and 32). The two round holes 21 and 22 are to be aligned with two oblong holes 111 and 112 on the upper leather part 11 respectively, while the two holes 31 and 32 are to be aligned with two oblong holes 121 and 122 on the lower leather part respectively. The strip 2 is used for clamping banknotes, while strip 3 is used for clamping notebook paper. The sub-wallet 4 is a rectangular member, which includes two inner leather sheets 41 and 42, each of which has two oblong holes 411 and 412 (or 421 and 422). The oblong holes 411 and 412 are to be aligned with the oblong holes 111 and 112 respectively on the upper leather part 11, while the oblong holes 421 and 422 are to be aligned with the oblong holes 121 and 122 on the lower leather part 12. The inner side of the upper inner leather sheet 41 has a partition flap 413 to be semi-opened and a lid flap 414 to be opened fully. The lower inner leather sheet 42 has several coin pockets 423 which have different diameters so as to receive coins with different diameters respectively, and a common flap 424 for all coin pockets.

Figure 2:
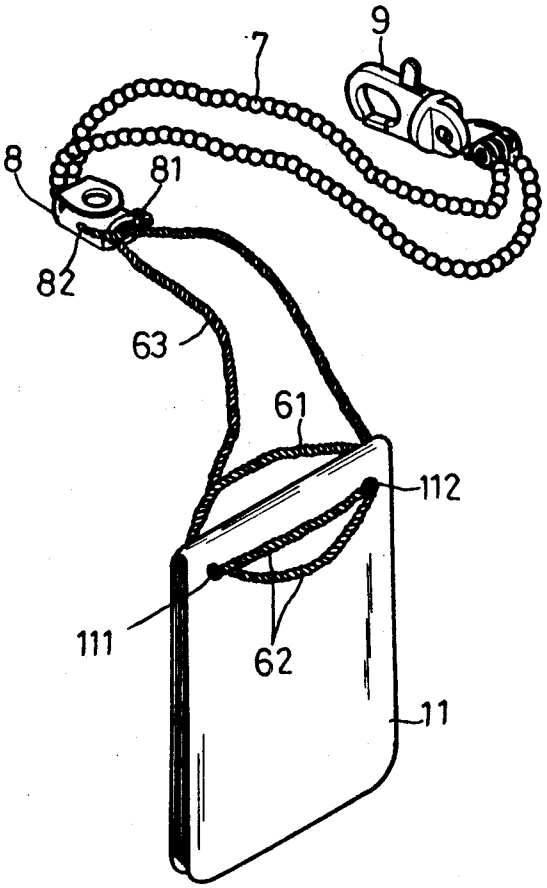
FIG. 2 is a perspective view an assembled wallet according to the present invention.

The wallet is to be assembled by first putting the sub-wallet 4 over the inside of the upper and lower leather parts 11 and 12 of the leather cover 1 so as to have the four oblong holes 411, 412, 421 and 422 of the sub-wallet 4 coincided with the four oblong holes 111, 112, 121 and 122 on the upper and lower leather parts 11 and 12 respectively; a strip 3 is then put above the sub-wallet 4 so as to have two holes 421 and 422 on the lower inner leather sheet 42 coincided with the two holes 31 and 32 of the strip 3. Fold the sub-wallet 4 over to wrap around the strip 3. Another strip 2 is mounted on the outer side of the upper inner leather sheet 41 of the sub-wallet 4 in such a manner that the two holes of the strip 2 are aligned with two holes 411 and 412 respectively; then, fold the leather cover 1 around strips 2 and 3 and the sub-wallet the holes 111, 21, 411, 31, 421 and 121 on one side aligned in regular sequence, and the holes 112, 22, 412, 32, 422 and 122 on the other side aligned in regular sequence. In that case, the holes 111 and 112 on the upper leather part 11 are in alignment with the two holes 121 and 122 on the lower leather part 12. As shown in FIG. 2, a string can pass through the holes 111 and 112 to surround the upper and lower leather parts 11 and 12 with one and half turns; then, the outside of the lower leather part 12 has a single string 61, while the outside of the upper leather part 11 has dual strings 62. In that case, the strip 2 is wrapped up with the leather cover 1, being fixed at its folded midpoint. Another strip 3 is wrapped up with the sub-wallet 4, being indirectly fixed nearing the folded midpart of the leather cover 1. The string 6 is used to tie together the leather cover 1, the sub-wallet 4 and the two strips 2 and 3; the string 6 has two extended ends 64 and 65 as shown in FIG. 1 to pass through a cylindrical passage 81 and two side holes 82 of a hook 8.

Figure 3:
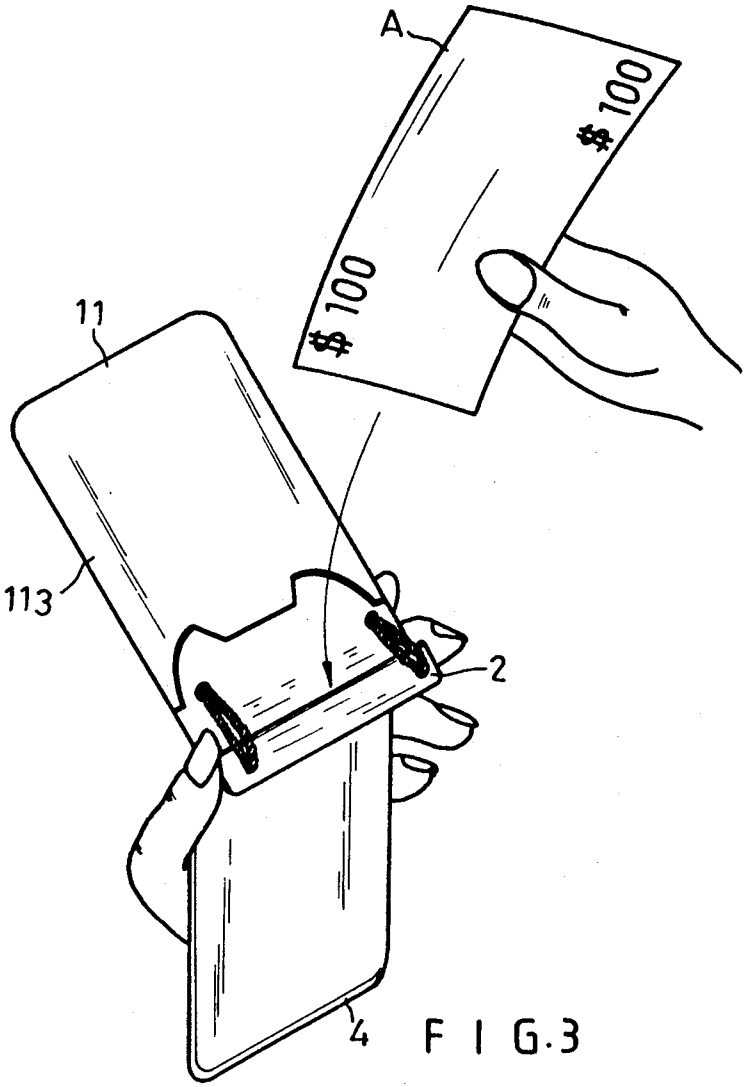
FIG. 3 is a perspective view of the FIG. 2 wallet while it is being loaded with a banknote.
Figure 4:
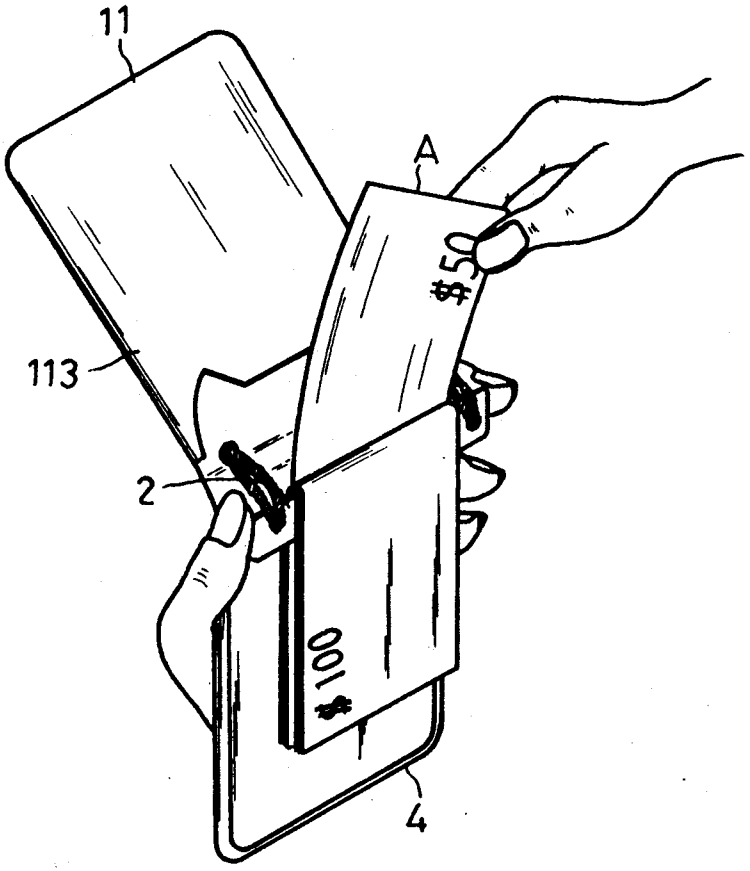
FIG. 4 illustrates a banknote being pulled out of the wallet of the present invention.

Referring to FIGS. 3 and 4, the wallet according to the present invention shows how a user can put in and take out a banknote therefrom. As shown in FIG. 3, the strip 2 will be seen upon the upper leather part 11 of the leather cover 1 being opened; then, the dual string 62 outside the upper leather part 11 is loosed first as shown in FIG. 2 so as to lift up the strip 2, and then a space is left under strip 2 to facilitate a banknote A to be inserted therein. After a banknote A is inserted under the strip 2, pull the extension string 63 tightly so as to have the banknote A clamped under the strip 2; then, pull the lower string to have the banknote A bent so as to close the leather cover 1.

Figure 5:
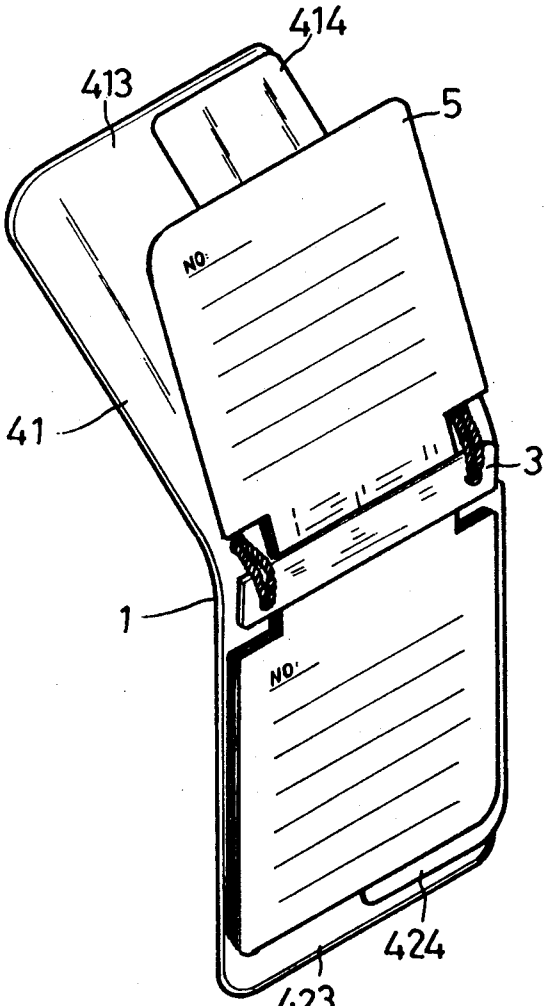
FIG. 5 illustrates a notebook part according to the present invention.

As shown in FIG. 4, the banknote A may be pulled out by first loosening the dual string 62, and a given number of banknotes can be pulled out of the strip 2. As shown in FIG. 5, another strip 3 same as strip 2 is used for clamping a plurality of notebook paper 5 for making notes. The notebook paper may be used to confuse a pick-pocket to prevent a real banknote from being picked.

Referring to FIG. 1, the upper leather sheet 41 of the sub-wallet 4 has a partition flap 413, which can be opened for storing ID card, or the like. The lid flap 414 is used to keep the partition flap closed. The coin pockets 423 on the lower inner leather sheet 42 are used for storing coins of different diameters, and the pockets can be closed with a common flap 424. A coin or coins can be poured out by reversing the pockets and slightly hitting the same.

Figure 8:
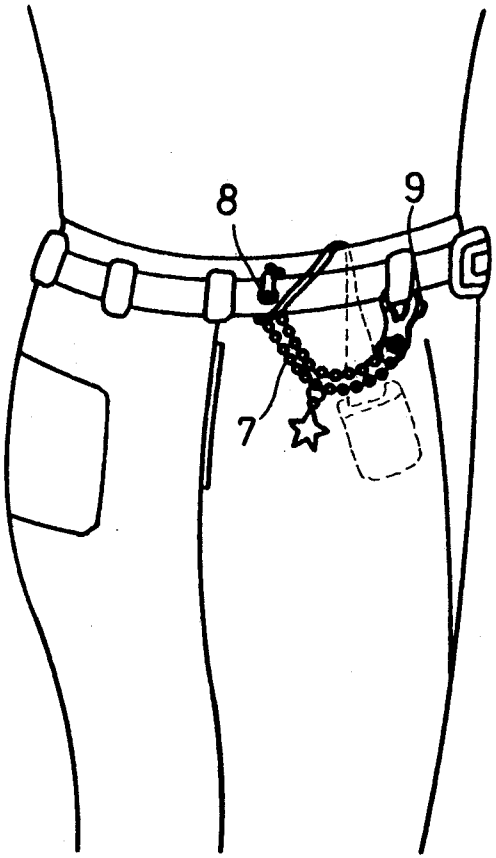
FIG. 7 and 8 illustrate how the present invention may be attached to user's belt.

The string ends 64 and 65, the bead chain 7 and the fastening hook 9 are connected together to facilitate the wallet to be attached to a user's garment or the like to prevent the wallet from being removed. The hook 8 attached to the string 6 and the bead chain 7 can hook on the user's belt; the bead chain 7 is to be attached on the upper edge of a user's pants as a decorative article (as shown in FIG. 7.). The wallet may be put inside a user's pants by means of the string for additional safety in the event of walking in a public place so as to prevent the wallet from being picked (as shown in FIG. 8). Since the hook 8 is attached to the string ends 64 and 65, the length of string 6 may be adjusted by pulling the dual string 62 outside the upper leather part 11 (as shown in FIG. 2). The dual string 62 may also be used for attaching a key or keys (as shown in FIG. 6); in that case, a user may just pull the key for adjusting the tension of the dual string 62.

The wallet according to the present invention can hold a large number of banknotes between the two strips 2 and 3 so long as the banknotes can be folded into two halves. After a given number of banknotes are put between the two strips 2 and 3, pull the extension string 63 for firmly clamping the banknotes in place; then, pull the string further to have the banknotes folded, and to have the leather cover 1 folded up. The number of sub-wallets 4 may also be added for storing more cards and coins, if necessary.

Since the wallet has a string 6, one of the dual strings 62 may be pulled out to form into a dual loop with the extension string 63, i.e., the wallet may be used as a handbag to be hung on a user's wrist for further convenience.

Figure 6:
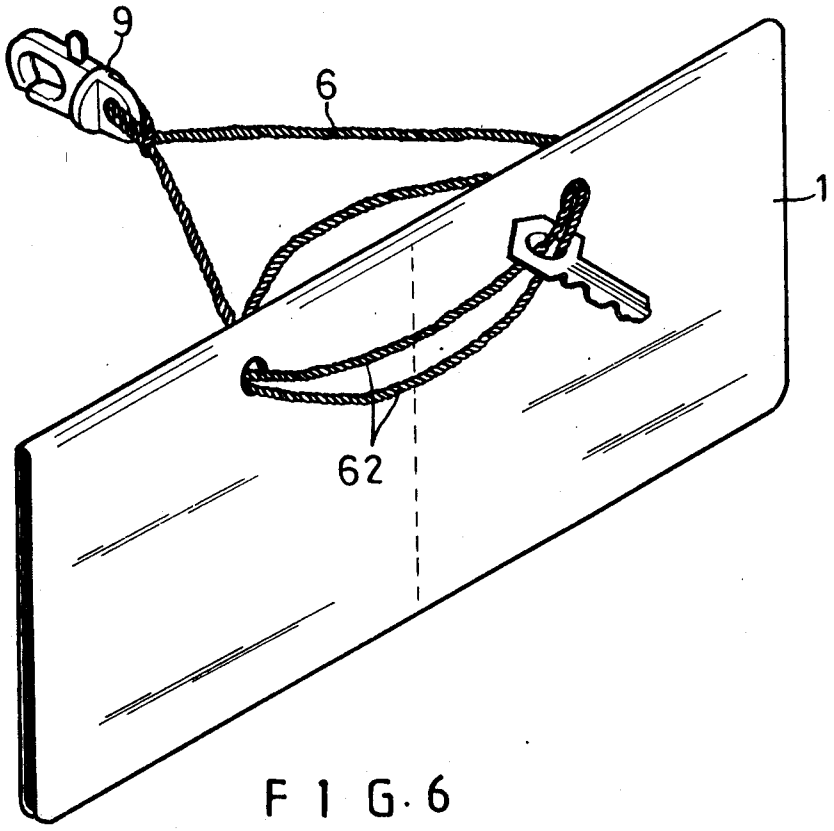
FIG. 6 is a perspective view of another embodiment according to the present invention.
Figure 7:
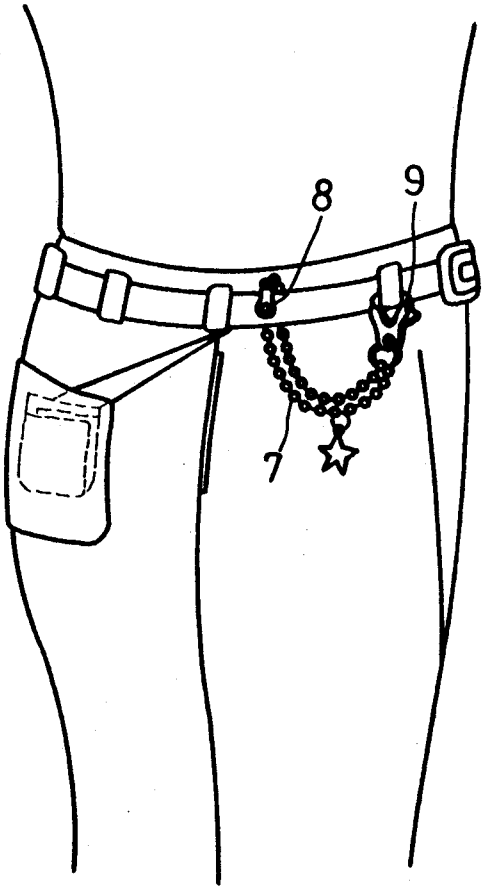

FIG. 6 is a perspective view of another embodiment according to the present invention, in which the strips 2 and 3, the sub-wallet 4, and the leather cover 1 are designed into a longer size (without changing the inner structure as mentioned above). The extension string 63 and one of the dual string 62 can be pulled together as a dual loop to be held with hand. The string is also provided with a fastening hook 9 for hooking convenience.

I claim:

1. A multi-function wallet comprising:

a rectangular cover (1) having a folded position a length dimension and a width dimension, said cover being foldable on a fold line parallel to its width dimension to form two cover half sections (11 and 12); said cover half sections having inner surfaces and outer surfaces when in said folded position;

a sub-wallet (4) foldable to form two inner wallet half sections (41 and 42);

said sub-wallet being nested within said cover so that the wallet half sections are located between the cover half sections when in said folded position a first rectangular strip (2) located between one of the wallet half sections and one of the cover half sections in near proximity to the cover fold line;

a second rectangular strip (3) located between said wallet half sections in n ear proximity to the cover fold line;

two sets of aligned holes extending through said cover half sections, said wallet half sections and said rectangular strips; said sets of holes being spaced apart by a distance greater than a width dimension of a bank note; and a single string (6) extending through said holes and along outer surfaces of the cover half sections, said string having exposed portions thereof extending away from the cover to form manual handles for tightening the grip of the string on the cover half sections, whereby the cover half sections exert clamping forces on the rectangular strips and the wallet half sections;

said first rectangular strip constituting a retainer adapted for receiving bank notes folded therearound between said one cover half section and said one wallet half section said second rectangular strip constituting a retainer adapted for receiving notebook sheets folded therearound between said other cover half section and said other wallet half section.

2. The multifunction wallet of claim 1, and further comprising a hook (8) connected to the exposed portions of said string, said hook being installable on the belt of the person carrying the wallet, whereby the wallet is protected against theft by a pickpocket.

3. The multi-function wallet of claim 1, wherein said wallet half sections have facing surfaces; each wallet half section has at least one pocket therein for concealed storage of articles; said pockets being located on the facing surfaces of the wallet half sections so as to be accessible when the wallet half sections are swung away from each other.

4. The multi-function wallet of claim 1, wherein some of said pockets are adapted for storage of coins in overlapped side-by-side positionment.

* * * * *